United States Patent [19]

Kirkpatrick

[11] 4,301,710

[45] Nov. 24, 1981

[54] CONTROL FOR GUN BOLTS IN A HIGH RATE OF FIRE REVOLVING BATTERY GUN

[75] Inventor: Robert G. Kirkpatrick, Shelburne, Vt.

[73] Assignee: General Electric, Burlington, Vt.

[21] Appl. No.: 118,028

[22] Filed: Feb. 4, 1980

[51] Int. Cl.[3] ..... F41D 7/02

[52] U.S. Cl. ..... 89/12; 89/172

[58] Field of Search ..... 89/12, 13 R, 172, 185

[56] References Cited

U.S. PATENT DOCUMENTS

| | | | |
|---|---|---|---|
| 125,563 | 4/1872 | Gatling | 89/12 |
| 2,849,921 | 9/1958 | Otto | 89/12 |
| 3,380,343 | 4/1968 | Chiabrandy et al. | 89/12 |
| 3,611,871 | 10/1971 | Kirkpatrick et al. | 89/127 |
| 3,766,821 | 10/1973 | Cozzy et al. | 80/12 |

OTHER PUBLICATIONS

Technical Report ADTC-TR-73-66 (FIG. 14) Gau-8/A "Gun System" Eglin AFB, Fl., Sep. 1973.

*Primary Examiner*—David H. Brown

*Attorney, Agent, or Firm*—Bailin L. Kuch

[57] ABSTRACT

A feature of this invention is the provision of a Gatling type gun having the minimum, yet adequate, longitudinal clearance between the locking lugs of the rotor and the locking lugs of the gun bolts, by having the helical main cam track of the gun which reciprocates the gun bolts between forward dwell and aft dwell during each gun cycle also provide a subcycle of reciprocation of each gun bolt while it is in front dwell. This subcycle provides adequate clearance of the lugs of the rotor and the gun bolts to permit free rotation of the bolt into and out of lock, while providing no clearance during actual firing.

2 Claims, 4 Drawing Figures

0°
FIRE
UNLOCK
LOCK
Aa
Ad
24
EXTRACT
RAM
FEED
180°
UNLOAD 32
44
40

CONTROL FOR GUN BOLTS IN A HIGH RATE OF FIRE REVOLVING BATTERY GUN

BACKGROUND OF THE INVENTION

1. Field of Art

This invention relates to a mechanism for controlling the forward dwell of the gun bolt in a Gatling type gun.

2. Prior Art

The classic modern revolving battery gun is shown by R. J. Gatling in U.S. Pat. No. 125,563, issued Apr. 9, 1872. A stationary housing encloses and supports a rotor assembly which has a plurality of barrels and a like plurality of gun bolts. Each gun bolt has its own firing pin and mainspring. Each gun bolt is reciprocated longitudinally by a stationary elliptical cam track in the housing. As the gun bolt is traversed forward, the firing pin is held to the rear by a stationary cam track in the housing and its mainspring is compressed until the bolt and the respective barrel reach the firing position, at which time the firing pin is seared. Improvements on the mechanism for locking the gun bolt are shown by H. McC. Otto in U.S. Pat. No. 2,849,921 issued Sept. 2, 1958; by R. E. Chiabrandy et al in U.S. Pat. No. 3,380,343 issued Apr. 30, 1968; R. G. Kirkpatrick et al in U.S. Pat. No. 3,611,871 issued Oct. 12, 1971 and by T. W. Cozzy et al in U.S. Pat. No. 3,766,821 issued Oct. 23, 1973.

SUMMARY OF THE INVENTION

It is an object of this invention to provide an improved Gatling gun having increased life of both the breech rotor and the gun bolts by reducing the torque necessary to unlock the gun bolt.

It is another object to provide a Gatling gun requiring less gun torque, i.e., the power necessary to drive the gun, by reducing the torque necessary to unlock the gun bolt.

A feature of this invention is the provision of a Gatling type gun having the minimum, yet adequate, longitudinal clearance between the locking lugs of the rotor and the locking lugs of the gun bolts, by having the helical main cam track of the gun which reciprocates the gun bolts between forward dwell and aft dwell during each gun cycle also provide a subcycle of reciprocation of each gun bolt while it is in front dwell. This subcycle provides adequate clearance of the lugs of the rotor and the gun bolts to permit free rotation of the bolt into and out of lock, while providing no clearance during actual firing.

BRIEF DESCRIPTION OF THE INVENTION

These and other objects, features and advantages of the invention will be apparent from the following specification thereof taken in conjunction with the accompanying drawing in which.

THE PREFERRED EMBODIMENT

Figure 1:
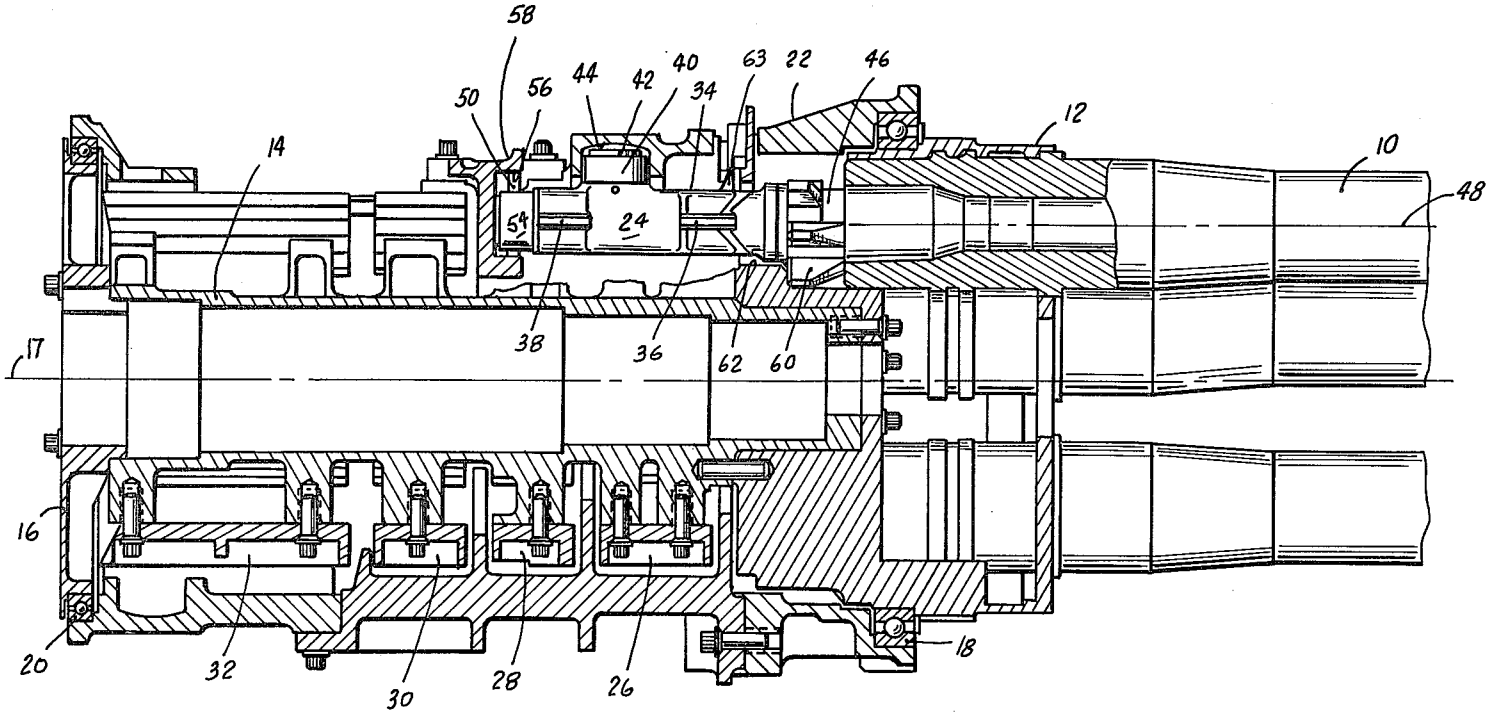
FIG. 1 is a longitudinal cross-section of a Gatling type gun embodying this invention.

The Gatling gun shown in FIG. 1 has a bolt locking system which is substantially of the type shown in U.S. Pat. No. 3,611,871 issued to R. G. Kirkpatrick et al on Oct. 12, 1971 and in the GAU-8/A gun described in Technical Report ADTC-TR-73-66 of Sept. 1973. Reference may be had to U.S. Pat. No. 3,611,871, the disclosure of which is hereby incorporated by reference for subject matter omitted herein. The gun bolt in U.S. Pat. No. 3,611,871 has a telescoping two-part body, while the gun bolt in the GAU-8/A gun, shown in FIG. 14 of the report, has a rigid body. In each case, the longitudinal reciprocation of the gun bolt is controlled by a stationary main cam track in the gun housing driving a cam follower or roller mounted to the gun bolt on a radial axis, and the locking and unlocking rotation of the head of the bolt is controlled by a stationary cam track in the gun housing driving a cam follower mounted to the gun bolt on an axis which is parallel to and spaced from the longitudinal axis of the gun bolt.

Briefly, the gun includes a plurality, e.g., five, of gun barrels 10, fixed to a forward rotor 12, which is fixed to an aft rotor 14, which is fixed to an aft cover 16, and are all journaled for rotation about a longitudinal axis 17 by a forward bearing 18 and an aft bearing 20, in a stationary three-part housing 22. A plurality, e.g., five, of sets of tracks are bolted to the rotor, to receive between adjacent sets a like plurality of gun bolts 24. Each set includes tracks 26, 28, 30 and 32. Each gun bolt assembly 24 includes a bolt carriage or body 34 having slides 36, 38 which engage the tracks of the rotor. A gun bolt roller or cam follower 40 is journaled to a headed pin 42 which is fixed on a radial axis to the bolt body 34. This roller 40 rides in the main cam track 44 formed in the housing 22. As the rotor assembly 12, 14 rotates with its gun bolts 24, the main cam track 44 reciprocates the gun bolts to and between their forward and aft dwells. A breech bolt or bolt head 46 is journaled in the bolt body 34 for limited oscillation about its longitudinal axis 48. A linear rotory motion roller 50 is journaled on a headed pin which is fixed to a cam follower 54 on an axis which is parallel to and spaced from the longitudinal axis of the bolt head. The cam follower is fixed to and coaxial with the bolt head. During front dwell of the gun bolt the roller 50 engages a cam track 56 formed in a locking cam 58 which is fixed to the gun housing 22. As the rotor assembly rotates, the cam track 56 oscillates the bolt head 46 about its longitudinal axis 48 from unlock to lock to unlock, whereby the locking lugs 60 on the bolt head engage and disengage with the locking lugs 62 formed in the forward rotor 12 adjacent the aft ends of the gun barrels 10.

Figure 2:
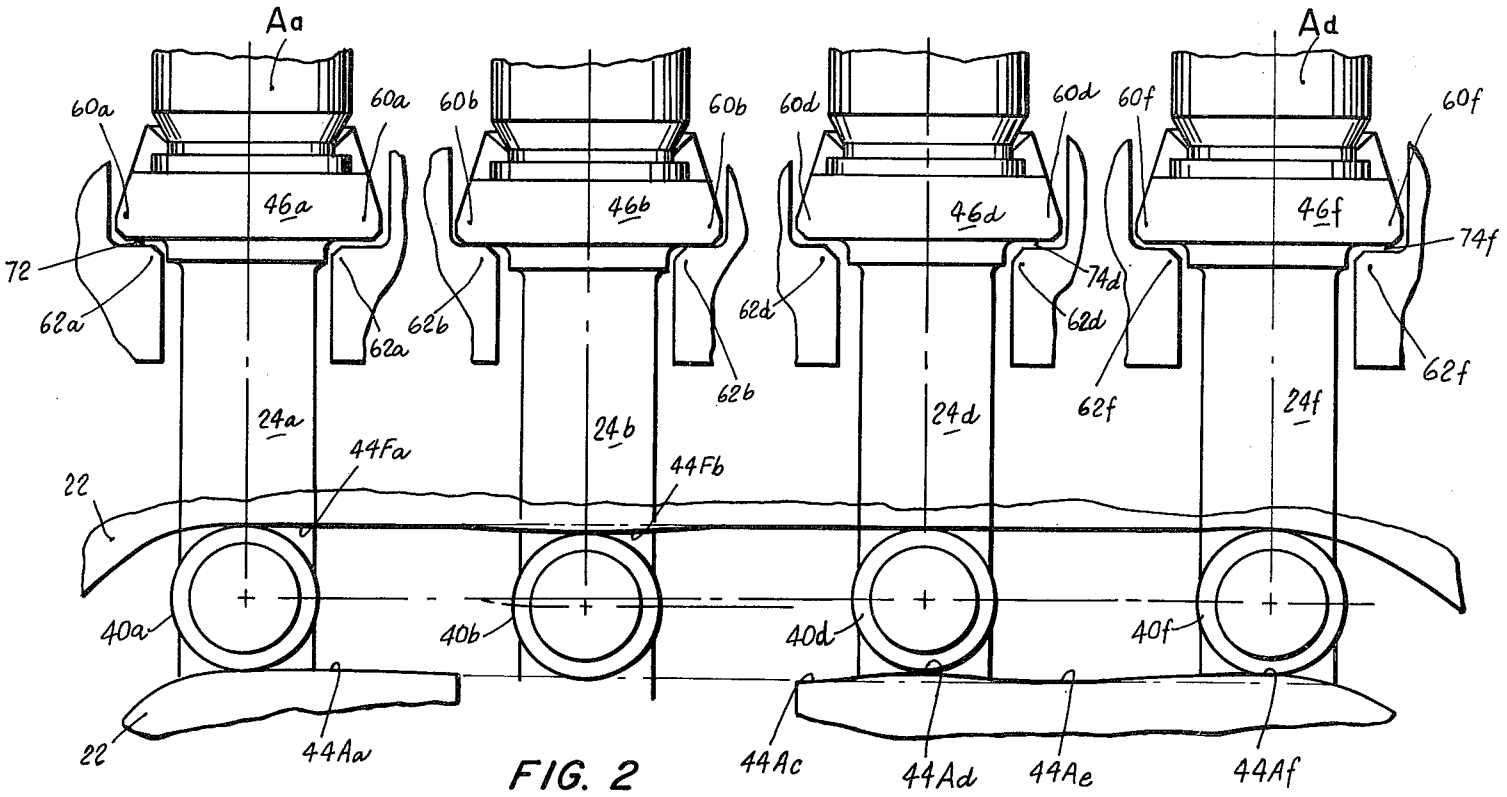
FIG. 2 is a developed plan of the front dwell portion of the main cam track showing its subcycle reciprocating of a gun bolt with respect to the locking lugs of the chambers of the gun barrels which are fixed in the rotor.
Figure 4:
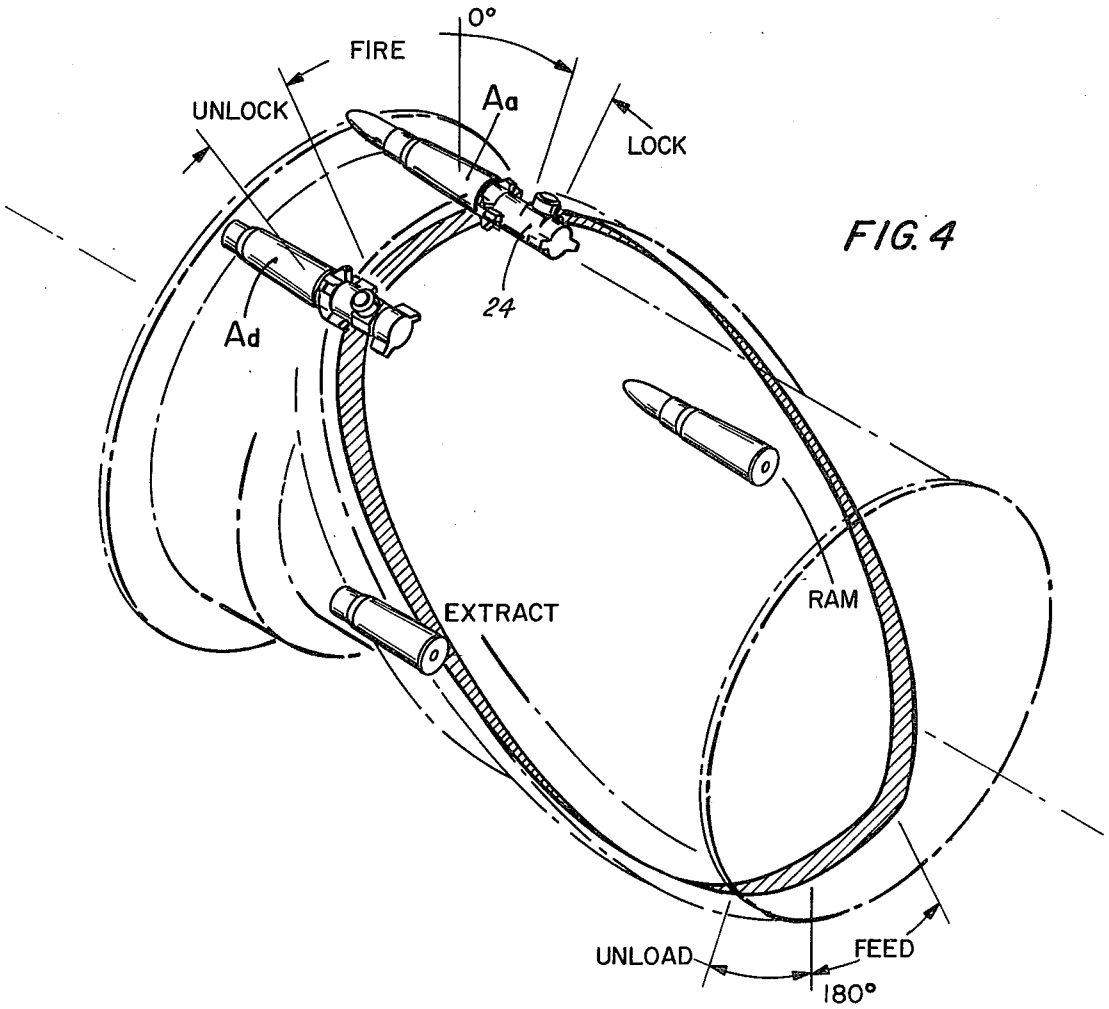
FIG. 4 is a perspective sketch showing the gun cycle as defined by the main cam track.
Figure 3:
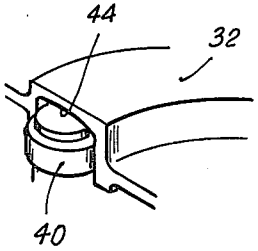
FIG. 3 is a detail perspective view showing the main cam and the gun bolt roller.

FIG. 2 shows four of the gun bolt assemblies **24*a*, 24*b*, 24*c* and 24*d* in their forward dwell with their respective bolt heads 46*a*, 46*b*, 46*c* and 46*d* disposed in their lock angular orientations having their respective locking lugs 60*a*, 60*b*, 60*c* and 60*d* in interengaging alignment with the respective locking lugs 62*a*, 62*b*, 62*c* and 62*d* of the front rotor 12. Their respective rollers 40*a*, 40*b*, 40*c* and 40*d* are disposed in the main cam track 44 in the housing 22 having a forward wall 44F and an aft wall 44A. A gap 70** is provided in the housing to permit the insertion and the removal of the gun bolt assemblies through the housing into the rotor assembly.

The bolt assembly **24*a* is shown in an early in-lock disposition with the conventional over-ram gap between 72 between the bolt locking lugs 60*a* and the rotor locking lugs 62***a*. This gap permits the bolt head 46*a*, (with its round of ammunition Aa) to be rotated into the lock angular orientation with an absence of frictional engagement between the bolt locking lugs and the rotor locking lugs. This gap 72 is provided by the aft cam wall portion 44A*a* pushing the roller forwardly. The forward cam wall portion 44F*a* is spaced from the roller by the conventional interfit tolerance.

The bolt assembly 24*b* is shown in the before-firing disposition. A rearwardly projecting bulge portion 44F*b* in the otherwise substantially flat forward cam wall of the forward dwell portion of the cam track has progressively pushed the bolt assembly aftwardly to firmly abut and hold the bolt locking lugs against the rotor locking lugs. During firing the reaction forces will continue to hold the bolt aft. However, the initial firing impulse will be instantly and directly transmitted by the bolt head to the rotor without any violent movement, or resulting mutual brinelling by the bolt head locking lugs against the rotor locking lugs.

The aft cam wall portion 44A*c* is even with the cam wall portion 44A*a* to clear and to receive the roller after firing. The bolt locking lugs are still in firm abutment with the rotor locking lugs.

The bolt assembly 24*d* is shown in a late lock disposition. A forwardly projecting bulge portion 44A*d* in the aft cam wall has progressively pushed the bolt assembly forward to space the bolt locking lugs from the rotor locking lugs with a gap 74i d. This gap permits the bolt head 46*d* (with its fired cartridge case Ad) to be rotated into the unlock angular orientation with an absence of frictional engagement between the bolt locking lugs and the rotor locking lugs. As the bolt progresses to the unlock cycle the aft cam wall is relieved at 44A*e* to allow a substantially friction free mode of rotation to the unlock position by relieving the friction between the fired case and the face of the bolt, the friction of the cam wall on the roller, and consequently the friction between the forward portion of the carriage and the aft portion of the body bolt head.

The bolt assembly 24*d* is shown in a completely unlocked disposition. A forwardly projection bulge portion 44A*f* in the aft cam wall has progressively pushed the bolt assembly forward to space the bolt locking lugs from the rotor locking lugs with a gap 74*f*. This insures that the bolt head is in a completely forward position, similar to that described with respect to bolt assembly 24*a*, when the gun is rotated in the reverse direction.

I claim:

1. A Gatling type gun including:

a housing;

rotor means journaled for rotation in said housing;

said rotor having:

a plurality of gun barrels, a like plurality of sets of radially projecting locking lugs, and a like plurality of gun bolts, each of said gun bolts having:

a gun bolt carriage journaled for reciprocation in said rotor means to, through and between a front dwell position and an aft dwell position, and having:

a first cam follower, a gun bolt head journaled for oscillation in said carriage to and between a lock and an unlock angular orientation, and having:

a set of radially projecting locking lugs for interlocking with a respective set of said plurality of sets of locking lugs of said rotor means when said head is in its lock orientation and for deinterlocking with said respective set when in its unlock orientation, and a second cam follower;

said housing having:

a first cam coupled to said first cam follower of each of said gun bolt carriages for driving said carriages in reciprocation, and a second cam coupled to said second cam follower for driving said head in oscillation, said first cam and said second cam being so configured and arranged as to provide a mode of operation wherein:

each of said gun bolts with its head in its unlock orientation is driven initially into forward dwell whereat its locking lugs are spaced longitudinally by a gap forward of said locking lugs of said rotor, thereafter said head is driven into its lock orientation with its locking lugs radially aligned with, but longitudinally spaced from, said locking lugs of said rotor, thereafter, but prior to firing, said head with its head in its lock orientation is driven aftwardly to bring its locking lugs into longitudinal abutment with said locking lugs of said rotor, subsequently, after firing, said head is driven forwardly to longitudinally space its locking lugs by a gap forward of said locking lugs of said rotor, thereafter, said head is driven into its unlock orientation whereat its locking lugs are radially disaligned from said locking lugs of said rotor, and subsequently said bolt is driven out of forward dwell.

2. A Gatling type gun according to claim 1, for firing a round of ammunition having a case, wherein said first cam and said second cam are so configured and arranged as to provide a mode of operation furthermore wherein:

after firing and after said head has been driven forwardly to longitudinally space its locking lugs by a gap forward of said locking lugs of said rotor, and before said head is driven into its unlock orientation, longitudinal forward driving force is removed from said head whereby to permit said head to longitudinally float with respect to said carriage, said first cam, and the fired case.

* * * * *